United States Patent [19]

Lecerf et al.

[11] Patent Number: 4,705,059

[45] Date of Patent: Nov. 10, 1987

[54] ELECTROFLUIDIC TRANSDUCER OF THE NOZZLE/PLATE TYPE AND HYDRAULIC SERVO-VALVE EQUIPPED WITH SUCH A TRANSDUCER

[75] Inventors: Jean-Pierre Lecerf, Creil; Charles Favey, Gouvieux; Pierre Meurice, Le Blanc-Mesnil, all of France

[73] Assignee: Centre Technique des Industries Mecaniques, Senlis, France

[21] Appl. No.: 871,327

[22] Filed: Jun. 6, 1986

[30] Foreign Application Priority Data

Jun. 10, 1985 [FR] France ..... 85 08713

[51] Int. Cl.[4] ..... F15B 5/00; F15B 13/043

[52] U.S. Cl. ..... 137/82; 137/625.61; 137/625.62; 251/129.06

[58] Field of Search ..... 137/82, 625.61, 625.62; 251/129.06

[56] References Cited

U.S. PATENT DOCUMENTS

| | | | |
|---|---|---|---|
| 2,928,409 | 3/1960 | Johnson et al. | 137/82 |
| 3,152,612 | 10/1964 | Avery | 137/625.62 X |
| 3,174,716 | 3/1965 | Salter | 251/129.06 |
| 3,524,474 | 8/1970 | McCormick | 251/129.06 X |
| 3,598,020 | 8/1971 | Blok et al. | 137/82 X |
| 4,298,181 | 11/1981 | Corrado et al. | 251/129.06 |
| 4,340,083 | 7/1982 | Cummins | 251/129.06 X |
| 4,492,360 | 1/1985 | Lee et al. | 251/129.06 |
| 4,610,426 | 9/1986 | Brandner | 251/129.06 |

FOREIGN PATENT DOCUMENTS 2511752 10/1976 Fed. Rep. of Germany .

*Primary Examiner*—Gerald A. Michalsky

*Attorney, Agent, or Firm*—Wegner & Bretschneider

[57] ABSTRACT

The transducer comprises a piezoelectric double-layer plate, the movements of which, under the effect of electrical signals, directly control the flow from one or two spray nozzles. The plate is mounted in a floating manner, without any fastening, between fixed supports of the knuckle-type which do not impede the free deformation (flexion or bending) of the plate. The invention makes it possible to increase the "signal-voltage/movement" ratio of the plate and reduce the hysteresis to obtain greater accuracy and reliability of response.

6 Claims, 18 Drawing Figures

FIG_1
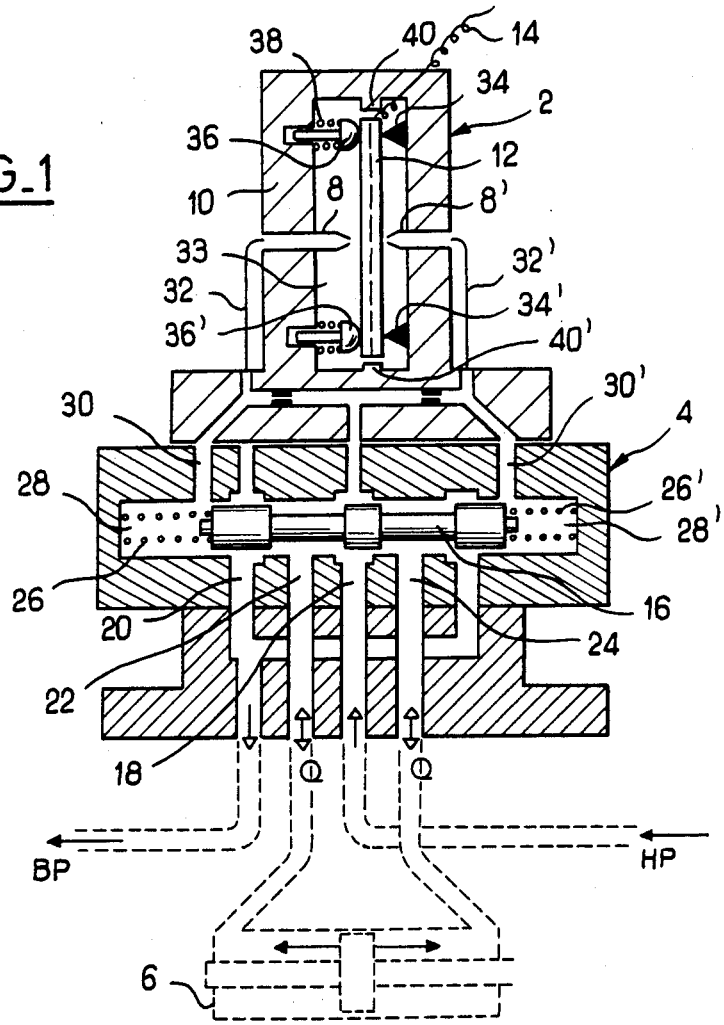
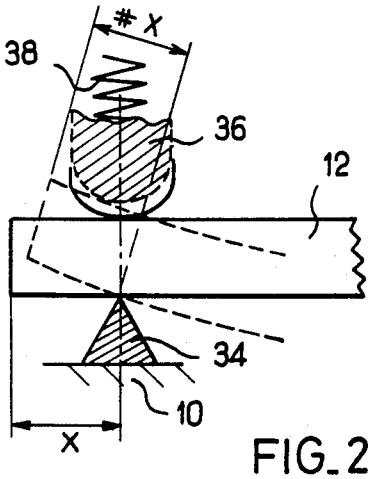
FIG_2
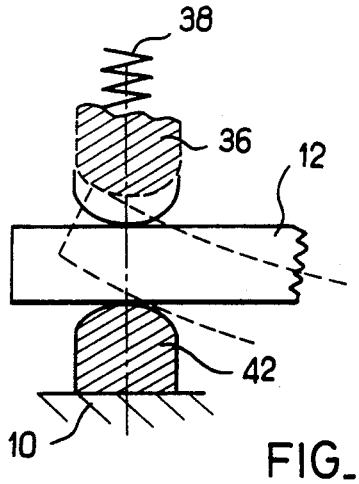
FIG_3

ELECTROFLUIDIC TRANSDUCER OF THE NOZZLE/PLATE TYPE AND HYDRAULIC SERVO-VALVE EQUIPPED WITH SUCH A TRANSDUCER

The present invention relates to an electrofluidic transducer of the nozzle/plate type, especially for controlling a hydraulic servo-valve by means of electrical signals.

The invention is aimed more particularly at a transducer, in which the movable plate consists of a piezoelectric double-layer strip, at least one of the faces of which interacts directly with at least one nozzle in order to control the flow rate from the said nozzle or the said nozzles as a function of the deformations of the said double-layer strip which are caused by the said electrical signals. The variation in flow rate from the nozzle or nozzles can be used, in a known way, to control the movements of the slide of a servo-valve.

A transducer of this type for controlling a servo-valve was described, for example, in German patent application No. DT-2,511,752 published on October 7th, 1976.

It is known that a piezoelectric double-layer strip is composed of two layers of materials separated by a common electrode. The crystals in one of the layers contract, whereas those in the other expand, thus causing the strip to bend.

In the transducers proposed hitherto, the double-layer strip is fastened rigidly, at its two ends or at only one of its ends (in the manner of a cantilever girder), in a housing containing the nozzles, so as to fix the position of rest of the double-layer strip in relation to the nozzles. Where the double-layer strip has a circular form, it can be fastened along the entire peripheral edge of the double-layer strip.

The servo-valves equipped with such transducers are valued for their reliability attributable to the small number of components in the transducer, for their low volumes and weights and for their very low electricity consumption under static conditions.

However, the accuracy and consistency of this type of servo-valve are insufficient for some uses. In fact, the curve of movement of the double-layer strip in relation to the associated nozzle as a function of the voltage applied to the double-layer strip can have a hysteresis of approximately 15%. As a result of this, the outlet characteristics of the servo-valve (pressure or flow rate) are subject to the same inaccuracy.

The object of the present invention is to overcome this disadvantage and improve the accuracy and consistency by means of an improved transducer.

The Applicant studied the deformation of piezoelectric double-layer strips and noted that it was impossible to hold the material firmly by fastening, without impairing the free expansion or contraction of the crystals and thereby influencing the "deformation behaviour" of the double-layer strip. In the fastening zone, the microcrystals undergo permanent compression, and at the edge of the fastening the material experiences a shearing force exerted by the end edge of the fastening surface. As a result of this, the flexion or bending of a fastened double-layer strip is less than the natural flexion or bending which this double-layer strip could experience freely, and furthermore the deformations are not identical over a complete cycle of variation of the electrical control voltage.

The Applicant discovered that it was possible to overcome the above-described disadvantages by means of a "floating" mounting of the piezoelectric double-layer strip.

The subject of the invention is a transducer of the nozzle/plate type, which has a piezoelectric double-layer strip interacting directly with the nozzle or nozzles, and in which the piezoelectric double-layer strip is only held in position opposite the nozzle or nozzles by members providing substantially point support or linear support, acting on the two opposing faces of the double-layer strip, located in the vicinity of the edges of the said double-layer strip, performing the function of pivots and allowing the free natural deformation of the said double-layer strip over its entire surface under the effect of the said electrical signals.

This arrangement dispenses completely with any fastening of the double-layer strip taking place over a considerable area of the latter.

Moreover, all else being equal, it has been possible, with a transducer according to the invention, to measure a hysteresis of the order of only 1% instead of approximately 15%, as indicated above.

The subject of the invention is also hydraulic servo-valves controlled by means of a piezoelectric hydraulic transducer such as that defined above.

The invention will be understood better by means of the description and the drawings which illustrate various embodiments of the invention.

FIG. 1 is a sectional view of a hydraulic servo-valve controlled by means of a transducer according to the invention.

FIGS. 2 and 3 are considerably enlarged partial views of the mounting of the double-layer strip both at rest and when the double-layer strip is deformed.

Figure 4:
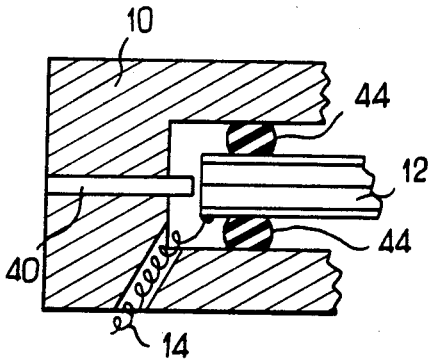
FIG. 4 illustrates the mounting of the double-layer strip by means of elastic supports.

The hydraulic servo-valve illustrated in FIG. 1 essentially comprises an electrofluidic transducer 2 forming a pilot stage for the distributor 4. Such a servo-valve can be used to control a receiver device, for example a double-acting hydraulic jack 6.

In the embodiment illustrated, the transducer 2 has two nozzles or spray jets 8, 8' which are fastened in a housing 10 and which open directly opposite the two faces of a preferably double-layer, piezoelectric plate 12, which responds somewhat like a bi-metallic strip, receiving the electrical control signal via a conductor 14.

As is known, the deformation of the plate 12 changes the flow ratio between the two nozzles 8, 8'.

The distributor 4 can be of any known type. It has, for example, a switching slide 16 which shuts off or opens the high-pressure and low-pressure ducts 18, 20 as well as the service ducts 22, 24 leading to the jack 6. The slide 16 is centered by means of springs 26, 26' and at its two ends delimits pressure chambers 28, 28' which communicate with the nozzles 8, 8' via ducts 30, 32, 30', 32'.

The mode of operation of such a servo-valve is sufficiently well-known that it suffices to state that the electrical signals applied to the piezoelectric plate 12 make it possible to control the drive member 6.

According to the invention, and as shown clearly in FIG. 1, the plate 12 is mounted "floating" in a chamber 33 limited by the walls of the housing 10, that is to say without any fastening of part of the plate in a rigid support, for example in the walls of the housing 10.

The plate 12 is only held in position opposite the nozzles 8, 8' by members providing substantially point support or linear support and forming a suspension of the knuckle type.

In FIG. 1 (assuming that the plate 12 is an elongate strip of rectangular shape), first means of support on one of the faces of the plate consist of two ridge-shaped supports 34, 34' integral with a first wall of the housing 10. Second means of support on the opposite face of the plate consist of elastic pressers 36, 36' which are laid against the plate by means of springs 38 and the heads of which are of spherical or cylindrical shape to minimize the friction and allow the plate to "roll" on the pressers. The elastic pressers 36, 36' are supported by the second wall of the housing 10.

The first members 34 form substantially linear supports, whilst the second members 36 form substantially point supports, the first and second supporting members being arranged opposite one another on the two opposing faces of the plate in the vicinity of the edges of the plate.

Setting stops or wedges 40, 40' (fixed or adjustable) can be provided in the housing 10, to ensure the longitudinal centering of the plate 12 in the housing.

FIG. 2 shows diagrammatically, on an enlarged scale, the system of floating mounting on only one of the edges of the plate 12, the plate being represented by unbroken lines in its plane position of rest and by broken lines in its curved position (considerably exaggerated) under the effect of an electrical voltage. It will be seen that the plate, when it is deformed, pivots without friction about the edge of the fixed support 34 and pushes back the movable elastic presser 36, without the free deformation of the plate being impeded practically at all, as occurred with the plates fastened in the housing.

In the alternative form illustrated in FIG. 3, the fixed support 42 no longer has a sharp edge, but a cylindrical supporting surface (or spherical where point support is concerned), so that the surface of the plate rolls against the surface of the supporting member.

In the alternative form shown in FIG. 4, the supporting members can consist (on one face or on both faces of the plate 12) of balls 44 made of elastic material or, when a plate of circular form is used, of O-rings made of elastic material.

Figure 5:
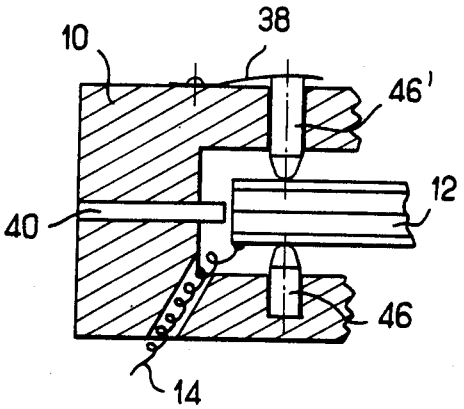
FIG. 5 illustrates the mounting of the double-layer strip by means of elastic mechanical supports.

In the alternative form illustrated in FIG. 5, the supporting members consist of fingers 46, 46' with a spherical or cylindrical head, the fingers 46 forming the fixed supports, whilst the fingers 46' are pressed elastically against the plate 12 by means of springs 38.

Figure 6:
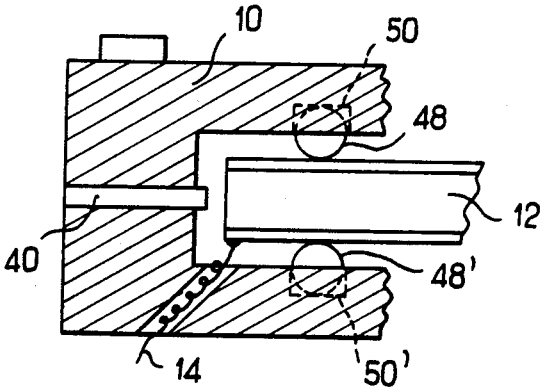
FIG. 6 shows knuckle-type supports of the double-layer strip by means of balls.

According to the alternative form in FIG. 6, the supporting members for the plate 12 consist of pairs of two metal balls 48, 48' seated in cavities 50, 50' made in the walls of the housing 10 of the transducer. The balls form, for the plate, a knuckle-type suspension which does not impede the free deformation of the plate.

Of course, the various types of supporting members described can be combined with one another, for example a metal ball (FIG. 6) opposite an elastic ball (FIG. 4) or opposite an elastic presser, such as 46' in FIG. 5.

Figure 8:
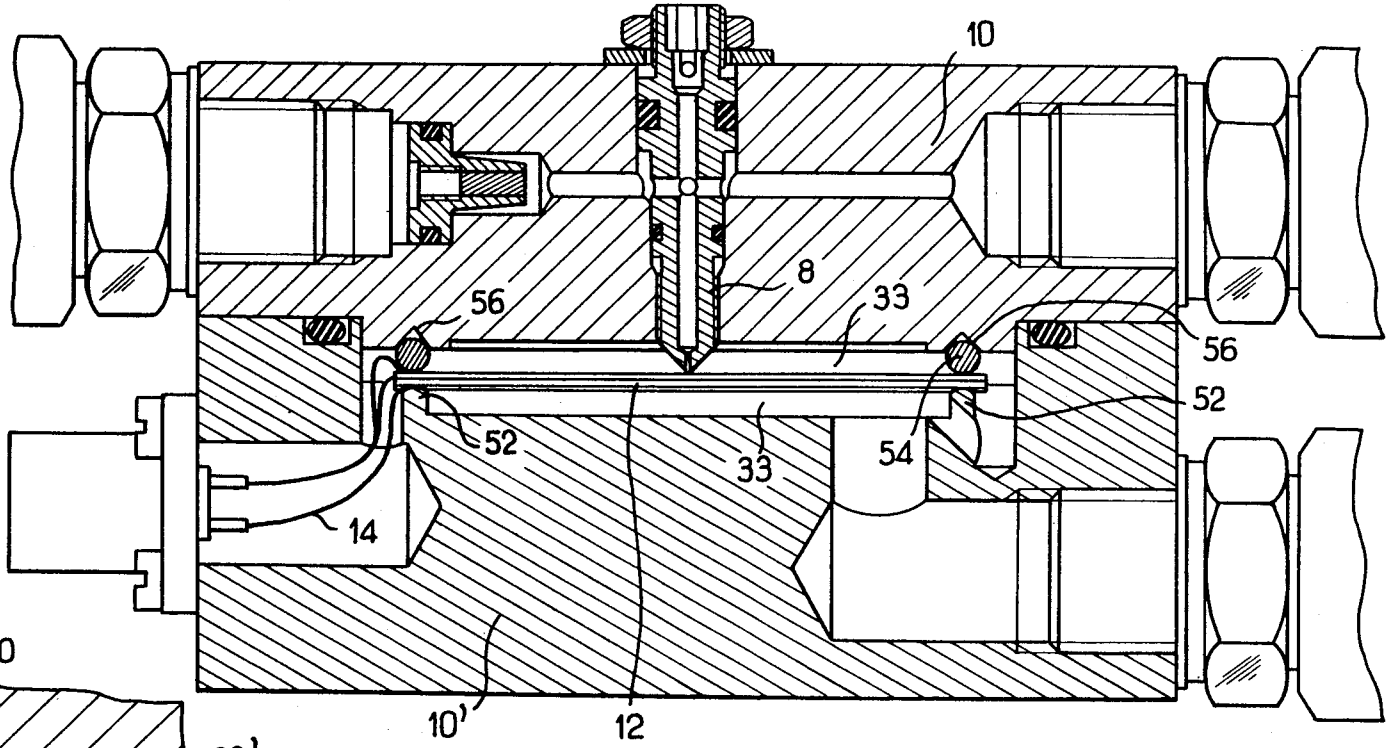
FIG. 8 is a sectional view of a transducer with a circular plate and with a single nozzle.

The number of pairs of supporting members can vary according to the shape of the plate. For example, for a rectangular plate, it is possible to use (FIG. 1) two pairs of supporting members, each comprising a linear support 34 and a point support 36, or three or four pairs of point-support members (FIGS. 4, 5 and 6).

Where a circular plate is concerned, it is advantageous to use three pairs of supporting members distributed at equal angular intervals or an infinity of continuous supporting points forming a continuous supporting line, as will be seen in relation to the embodiment shown in FIG. 8.

Figure 7:
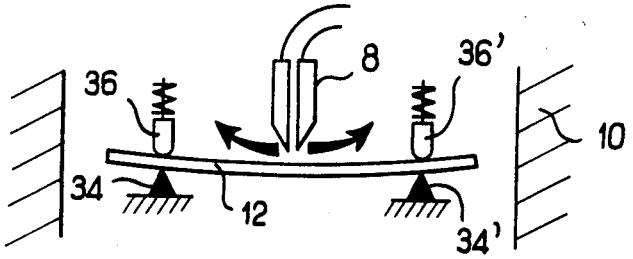
FIG. 7 is a diagrammatic view of a nozzle/plate transducer with a single nozzle.

The preceding description related mainly to transducers having a nozzle or spray jet located opposite each of the faces of the piezoelectric double-layer strip, the two nozzles operating differentially. However, the invention can of course also be used when the transducer has only a single nozzle 8 located opposite one of the faces of the plate 12, as shown diagrammatically in FIG. 7. Here again, the plate 12 is held in place by means of a floating mounting comprising knuckle-type supports 34, 34' and 36, 36', for example similar to those of FIG. 1.

FIG. 8 illustrates an embodiment of a transducer having a single nozzle 8 located opposite the plate 12, the latter having a circular, not rectangular shape.

The housing 10 is formed from two parts 10, 10' joined together. The part 10' of the housing has a projecting circular lip 52 which, for example, has a rounded profile and which forms a continuous line of supporting points, on which bears the lower face of the plate 12 and against which this lower face can move by rolling during the deformation of the plate.

The second supports, on the opposite face of the plate 12, consist of a O-ring of round cross-section 54 which is made of elastic material and which is positioned in a circular groove 56 made in the part 10 of the housing.

The circular plate 12 is thus supported in a floating manner, without fastening, in the vicinity of its peripheral edge by means of two continuous circular supporting lines facing one another.

Figure 9:
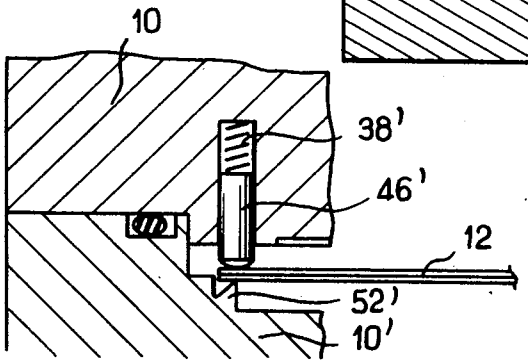
FIG. 9 is a partial view of the transducer of FIG. 8, with another embodiment of the system for mounting the plate.

An alternative form of this mounting for the same transducer is shown partially in FIG. 9, where the projecting circular lip 52' formed in the part 10' of the housing has an edge-shaped profile. The plate 12 is then free to pivot about this edge, as described with reference to FIGS. 1 and 2, this edge forming a continuous line of supporting points. The second supporting members can consist of a plurality (for example 3) of pressers 46' with a spherical head, which are subjected to the action of springs 38' and which are similar to those illustrated in FIG. 5.

Of course, the same method of suspension with supports in a continuous line and/or with point supports can be used for piezoelectric plates of polygonal shape.

Mechanical or elastic supporting members for holding the plate 12 in place have been described and illustrated hitherto, but it is also possible to use, on one of the faces or on both faces of the plate supporting members of the hydrostatic type similar to those used, for example, in hydrostatic bearings.

Figure 10:
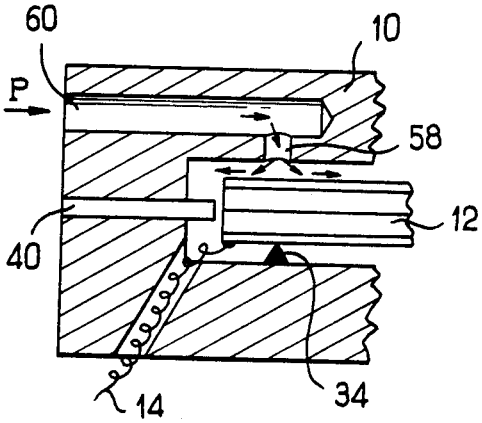
FIGS. 10 and 11 show the floating mounting of the plate by means of hydrostatic supports.

FIG. 10 shows diagrammatically a floating mounting of a plate 12 in a housing 10 by means of an edgeshaped mechanical support 34 on one of the faces of the plate, and by means of a hydrostatic nozzle 58 supplied with liquid under pressure via a duct 60.

Figure 11:
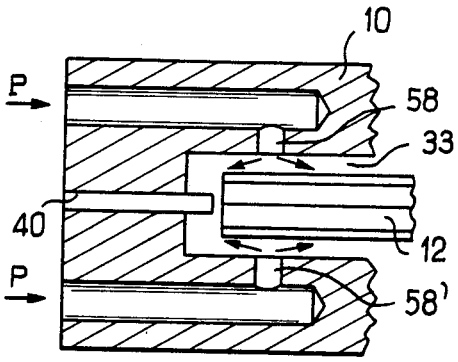

In the embodiment shown in FIG. 11, the suspension is obtained hydrostatically by means of nozzles 58, 58' on both faces of the plate 12, the latter being held centered in the housing 12 by means of centering wedges 40.

Of course, particularly where a plate of circular shape is concerned, a plurality of hydrostatic nozzles (for example, three distributed at equal angular intervals) is provided, the nozzles preferably feeding hydrostatic grooves or "pockets", as is customary for fluid bearings.

The above-described hydrostatic suspension system is advantageous, since it provides a sufficiently rigid suspension, without subjecting the plate to any mechanical friction, thus allowing the latter complete natural freedom of deformation. Furthermore, in a hydraulic servovalve, the hydraulic fluid under high pressure (for example, at 100 to 400 bars) is available for feeding the hydrostatic suspension, without the need for any additional installation. Of course, the double-layer strip functions in the hydraulic fluid (oil) which fills the chamber 33 of the housing, as in cases where the system supporting the plate is mechanical or elastic.

The preceding description related to transducers using rectangular, polygonal or circular piezoelectric plates, these plates being solid.

Figure 12A:
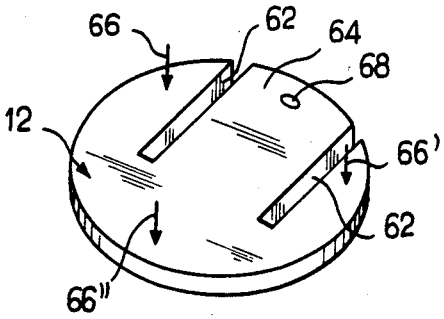
FIGS. 12A, 12B, 12C and 13A, 13B, 13C are perspective views of worked piezoelectric plates.
Figure 12B:
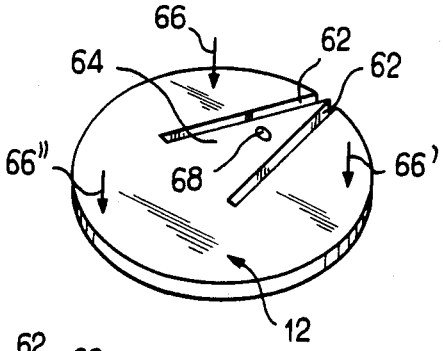
Figure 12C:
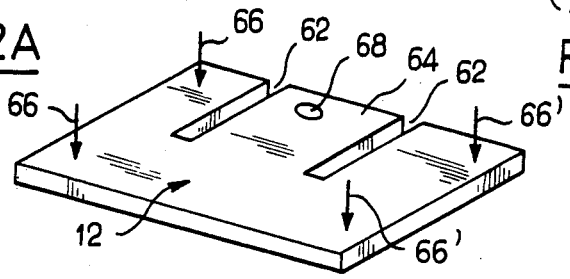

However, as shown in FIGS. 12A, 12B and 12C, it is also possible to use a worked plate 12 having notches 62 leaving between them at least one free tab 64, on which no supporting member acts.

The supporting members have been indicated by arrows 66, 66', 66'', and these supporting members can be of any one of the types described in the foregoing. The nozzle or nozzles indicated by their point of impact 68 on the plate 12 open out opposite the free tabs 64 of the plate. The notches 62 make it possible to adjust the flexibility of the double-layer plate, while at the same time shifting the influence of the mounting away from the zone of maximum stress.

Figure 13A:
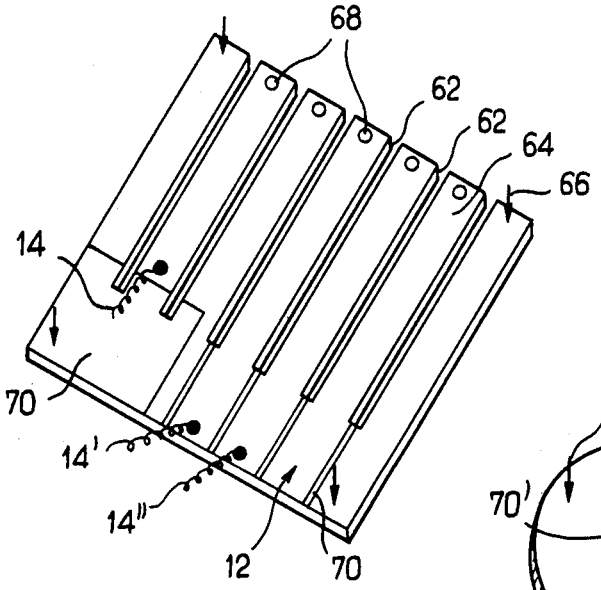
Figure 13B:
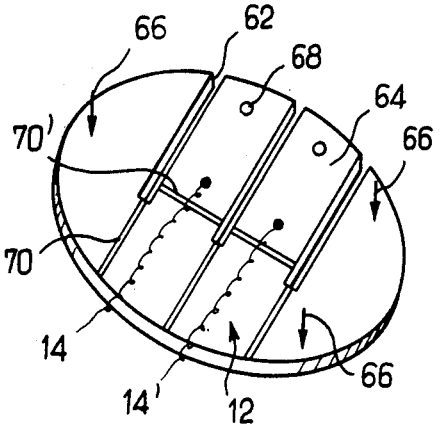
Figure 13C:
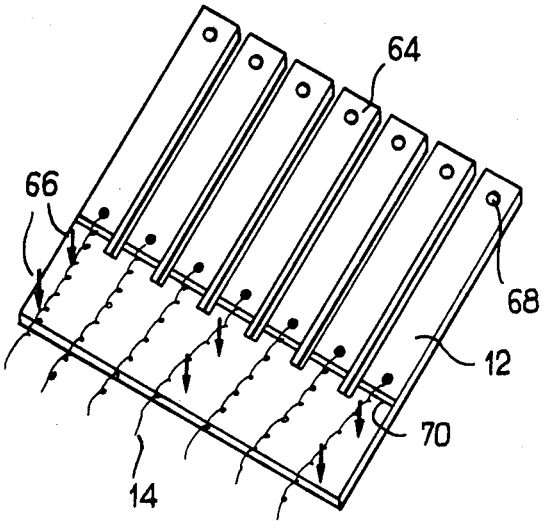

As shown in FIGS. 13A, 13B and 13C, it is also possible to provide more complex forms having several slits to produce double-layer strips 12 especially worked to perform multiple functions. Each active tab 64 of the double-layer strip can be associated with one nozzle or with two nozzles, the locations of which are indicated at 68. The supporting members have been represented symbolically by arrows 66.

Each tab 64 can be disconnected electrically from those adjacent to it by cutting off some of the electrodes by means of incisions 70 or 70' carefully arranged so as to disconnect the mechanical interaction of the double-layer strips 12, each active tab receiving its electrical signal via a separate conductor 14, 14', 14''. As shown in FIG. 13C, each active tab 64 can be mounted by means of two supports, the location 68 of the nozzle (or nozzles) being between two supports. However, as shown in FIGS. 12A, 12B, 12C, 13A and 13B, each tab 64 can be mounted by means of simple support in the manner of a cantilever girder, the location 68 of the nozzle then being at the free end of the strip, in order to benefit from the total deformation of the double-layer strip where the nozzle is concerned.

Figure 14:
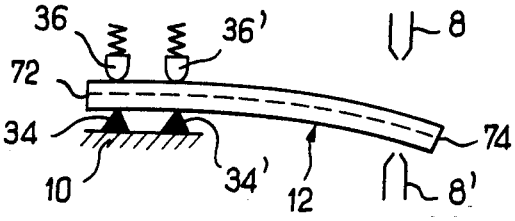
FIG. 14 is a diagrammatic representation of yet another alternative form of floating mounting of the plate in a transducer according to the invention.

A mounting similar to a cantilever mounting can also be provided for a plate 12 of simple elongate rectangular form, as shown diagrammatically in FIG. 14, where the deformation of the plate 12 has been exaggerated considerably. Here, two fixed supports 34, 34' brought close to one another are provided in the vicinity of one of the edges 72 of the plate and interact with opposing elastic supports 36, 36', whilst the nozzles 8, 8' interact with the plate 12 in the vicinity of its free edge 74, so as to utilize the total deformation of the double-layer strip over substantially its entire length.

It is known that one of the disadvantages of the piezoelectric double-layer strips used in nozzle/plate transducers has hitherto been the high control voltage which they require (more than 100 V and usually of the order of 200 V), and that the other disadvantages are the small amount of movement (a few tens of microns) which is impeded by the fastening or fastenings of the double-layer strip in the housing, and the inconsistency of the movements during a deformation cycle.

The system of floating mounting of the bi-metallic strip according to the invention, without any fastening, makes it possible to obtain a much higher "movement-/control-voltage" ratio and greatly reduce the hysteresis phenomenon.

What is claimed is:

1. An electrofluidic transducer, having at least one nozzle and a movable plate, in which said movable plate consists of a piezoelectric double-layer strip, at least one of the faces of which interacts directly with at least one nozzle to control the flow rate from said at least one nozzle as a function of the deformations of said double-layer strip which are caused by electrical signals, said piezoelectric strip being held in position opposite said at least one nozzle by supporting members acting on the two opposing faces of said strip and located in the vicinity of the edges of said strip, in which transducer the supporting members are in substantially point contact with the faces of said strip, said supporting members being arranged in pairs opposite one another on the two opposing faces of said strip, the supporting members located on one of the faces of said strip being fixed rigid supports, the supporting members located on the other face of said strip being movable in at least one direction perpendicular to the faces of said strip, and said supporting members forming, in pairs, knuckle-type pivots allowing the free natural deformation of said strip over its entire surface under the effect of said electrical signals.

2. The transducer as claimed in claim 1, wherein the movable supporting member is biased in said at least one direction by a spring.

3. The transducer as claimed in claim 1, wherein the supporting members consist of pressing fingers (36–42–46–46') with a substantially spherical hard end surface, and wherein the fingers (36–46') located on the other aforesaid face of the strip are stressed towards the strip by means of springs (38).

4. The transducer as claimed in claim 1 or 3, which comprises a housing (10) forming a closed chamber (33), the said housing supporting at least one fluid inflow nozzle (8), the mouth of which opens out opposite one of the faces of the strip (12), and in which the aforesaid supporting members (34, 36) are carried, inside the said chamber (33), by the walls of the housing.

5. The transducer as claimed in claim 4, wherein said strip (12) mounted freely between its supporting members is centered laterally in the aforesaid chamber (33) by means of centering wedges (40, 40') carried by the housing (10).

6. In combination, an electrofluidic transducer device as in claim 1 having at least one nozzle and a movable plate, said transducer being coupled to a hydraulic servo-valve, so as to control the movement of a slide of said servo-valve.

* * * * *